US009310761B2

(12) United States Patent
Okabe

(10) Patent No.: US 9,310,761 B2
(45) Date of Patent: Apr. 12, 2016

(54) IMAGE FORMING APPARATUS HAVING SUPPORTING MEMBER WITH RIGIDITY

(71) Applicant: Yasushi Okabe, Nagoya (JP)

(72) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/228,286

(22) Filed: Mar. 28, 2014

(65) Prior Publication Data

US 2014/0294437 A1 Oct. 2, 2014

(30) Foreign Application Priority Data

Mar. 29, 2013 (JP) ..... 2013-072077

(51) Int. Cl.

| | |
|---|---|
| ***G03G 15/00*** | (2006.01) |
| ***G03G 21/18*** | (2006.01) |
| ***G03G 15/01*** | (2006.01) |
| ***G03G 21/16*** | (2006.01) |

(52) U.S. Cl.

CPC ..... *G03G 21/1842* (2013.01); *G03G 15/0194* (2013.01); *G03G 21/1619* (2013.01); *G03G 21/1839* (2013.01); *G03G 2215/0141* (2013.01); *G03G 2221/1684* (2013.01)

(58) Field of Classification Search

CPC ..... G03G 15/0194; G03G 21/1839; G03G 21/1842; G03G 2221/1684

USPC ..... 399/111, 299

See application file for complete search history.

(56) References Cited

U.S. PATENT DOCUMENTS

| | | | | |
|---|---|---|---|---|
| 5,528,342 | A * | 6/1996 | Setoriyama | 399/107 |
| 5,701,553 | A * | 12/1997 | Endo et al. | 399/55 |
| 8,583,006 | B2 | 11/2013 | Murayama et al. | |
| 2007/0036581 | A1 * | 2/2007 | Okabe | 399/111 |
| 2007/0223958 | A1 * | 9/2007 | Mori et al. | 399/103 |
| 2007/0286632 | A1 * | 12/2007 | Okabe | 399/90 |
| 2008/0002341 | A1 * | 1/2008 | Tomatsu | 361/679 |
| 2008/0159773 | A1 | 7/2008 | Murayama et al. | |
| 2010/0111562 | A1 * | 5/2010 | Okabe | G03G 21/1853 399/112 |
| 2011/0064462 | A1 * | 3/2011 | Abe et al. | 399/117 |
| 2012/0177403 | A1 | 7/2012 | Murayama et al. | |
| 2012/0315063 | A1 * | 12/2012 | Kikuchi | G03G 21/1825 399/111 |

FOREIGN PATENT DOCUMENTS

JP 2008-165025 A 7/2008

* cited by examiner

*Primary Examiner* — Benjamin Schmitt

(74) *Attorney, Agent, or Firm* — Banner & Witcoff, Ltd.

(57) ABSTRACT

An image forming apparatus includes: a main casing, first and second cartridges, and a supporting member supporting the first and second cartridges. The first and second cartridges extend in a first direction and are arranged in a second direction generally perpendicular to the first direction when supported in the supporting member. The supporting member is movable between an inner position and outer position relative to the main casing. The supporting member includes: a first side plate and a second side plate opposite to each other in the first direction; a first beam member interposed between the first and second cartridges in the second direction when the supporting member supports the first and second cartridges, the first beam member extending in the first direction between the first and second side plates; and first and second fasteners for fastening the first beam member to the first and second side plates respectively.

19 Claims, 5 Drawing Sheets

IMAGE FORMING APPARATUS HAVING SUPPORTING MEMBER WITH RIGIDITY

CROSS REFERENCE TO RELATED APPLICATION

This application claims priority from Japanese Patent Application No. 2013-072077 filed Mar. 29, 2013. The entire content of the priority application is incorporated herein by reference.

TECHNICAL FIELD

The present invention relates to an electro-photographic image forming apparatus.

BACKGROUND

A known tandem-type color printer includes a main body and a plurality of cartridges detachably mountable in the main body.

One of such conventional color printers includes a main body and a cartridge tray configured to be held in the main body so as to be slidable relative to the main body. In this color printer, the cartridge tray supports therein a plurality of cartridges juxtaposed to one another (see Japanese Patent Application Publication No. 2008-165025).

SUMMARY

It is an object of the present invention to provide an improved image forming apparatus.

In order to attain the above and other objects, there is provided an image forming apparatus including a main casing, a first cartridge, a second cartridge and a supporting member. The first cartridge extends in a first direction and is configured to accommodate developer. The second cartridge extends in the first direction and is configured to accommodate developer. The supporting member is configured to support the first cartridge and the second cartridge such that the first cartridge and the second cartridge are arranged in a second direction generally perpendicular to the first direction, the supporting member being configured to move between an inner position disposed within the main casing and an outer position disposed outside of the main casing in the second direction. The supporting member includes a first side plate, a second side plate, a first beam member, a first fastener and a second fastener. The second side plate is positioned opposite the first side plate to be spaced away therefrom in the first direction. The first beam member is interposed between the first cartridge and the second cartridge in the second direction when the supporting member supports the first cartridge and the second cartridge. The first beam member extends in the first direction between the first side plate and the second side plate. The first fastener is configured to fasten the first beam member to the first side plate. The second fastener is configured to fasten the first beam member to the second side plate.

DETAILED DESCRIPTION

1. General Structure of the Printer

Figure 1:
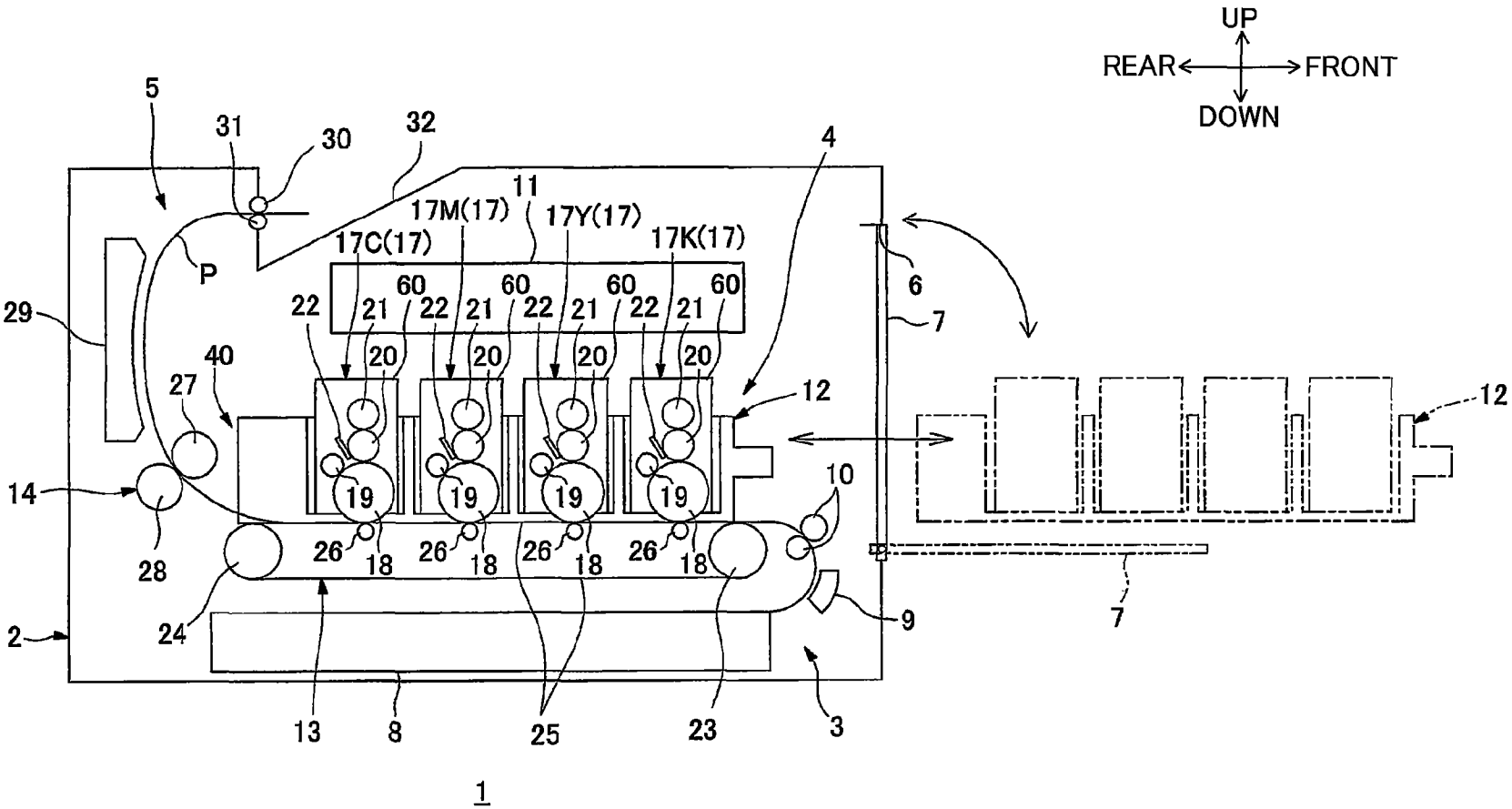
FIG. 1 is a schematic central cross-sectional view illustrating a general configuration of a printer according to an embodiment of the present invention, wherein the printer slidably accommodating a drawer unit according to the embodiment.

A printer 1 is a horizontal direct tandem-type color laser printer, as shown in FIG. 1. The printer 1 is an example of an image forming apparatus according to an embodiment of the present invention.

First, a general structure of the printer 1 will be described with reference to FIG. 1.

Throughout the specification, the terms "above", "below", "right", "left", "front", "rear" and the like will be used assuming that the printer 1 is resting on a level surface. More specifically, in FIG. 1, a right side, a left side, a near side and a far side will be referred to as a front side, a rear side, a left side and a right side of the printer 1, respectively.

(1) Main Casing

The main casing 2 has a substantially rectangular box shape in a side view. The main casing 2 has a front wall formed with a main body opening 6, and a front cover 7. The front cover 7 is configured to be pivotally movable about a lower end portion thereof between a closing position closing the main body opening 6 (show by a solid line in FIG. 1) and an opening position opening the main body opening 6 (shown by a dotted line in FIG. 1). The main casing 2 houses therein a sheet supply section 3 and an image forming section 4.

(2) Sheet Supply Section

The sheet supply section 3 has a sheet cassette 8, a sheet supply guide 9 and a pair of registration rollers 10. The sheet cassette 8 serves to accommodate sheets of paper P therein. The sheet cassette 8 is detachably attached to a bottom portion of the main casing 2.

The sheets P stacked in the sheet cassette 8 are fed one by one, and directed upward and rearward toward between the pair of registration rollers 10 while being guided along a U-shaped path by the sheet guide 9, and then conveyed at a prescribed timing toward between a photosensitive drum 18 (described later) and a conveying belt 25 (described later) of the image forming section 4.

(3) Image Forming Section

The image forming section 4 includes a scanner unit 11, a drawer unit 12, a transfer unit 13, and a fixing unit 14.

(3-1) Scanner Unit

The scanner unit 11 is disposed at an upper portion of the main casing 2. The scanner unit 11 emits a laser beam to each of a plurality of photosensitive drums 18 (described later) based on image data to expose the corresponding photosensitive drum 18 to light.

(3-2) Drawer Unit

The drawer unit 12 is disposed at a position generally center of the main casing 2 in an up-down direction and below the scanner unit 11.

The drawer unit 12 includes a drawer frame 40 and four process cartridges 17 corresponding to respective four colors used in the printer 1. The four process cartridges 17 are attachable to and detachable from the drawer frame 40.

The drawer unit 12 is configured to move in a front-rear direction between an inner position (denoted by a solid line) at which the drawer unit 12 is positioned inside the main casing 2 and an outer position (denoted by an imaginary line) at which the drawer unit 12 is positioned outside the main casing 2.

The four process cartridges 17 are arranged spaced away from one another in the front-rear direction in the drawer frame 40. Specifically, the process cartridges 17 include a black process cartridge 17K, a yellow process cartridge 17Y (an example of a claimed first cartridge), a magenta process cartridge 17M (an example of a claimed second cartridge), and a cyan process cartridge 17C arranged in the drawer frame 40 in the mentioned order from the front to the rear. That is, the yellow process cartridge 17Y (first cartridge) and the magenta process cartridge 17M (second cartridge) are arranged in the front-rear direction and accommodated in the drawer frame 40.

Each of the four process cartridges 17 has the photosensitive drum 18, a charging roller 19, a developing roller 20, a supply roller 21, and a thickness regulation blade 22 (the photosensitive drum 18, the charging roller 19, the developing roller 20, the supply roller 21, or the thickness regulation blade 22 is an example of a claimed processing body).

The photosensitive drum 18 has a substantially cylindrical shape extending in a left-right direction. The photosensitive drum 18 is rotatably supported by a lower end portion of the process cartridge 17. A lower end portion of the photosensitive drum 18 is exposed downward from the process cartridge 17.

The charging roller 19 has a substantially columnar shape extending in the left-right direction. The charging roller 19 is rotatably supported in the process cartridge 17 to be in contact with an upper rear portion of the photosensitive drum 18.

The developing roller 20 has a substantially columnar shape extending in the left-right direction. The developing roller 20 is rotatably supported in the process cartridge 17 to be in contact with an upper portion of the photosensitive drum 18.

The supply roller 21 has a substantially columnar shape extending in the left-right direction. The supply roller 21 is rotatably supported in the process cartridge 17 to be in contact with an upper portion of the developing roller 20.

The thickness regulation blade 22 is rotatably supported in the process cartridge 17 to be in contact with a rear portion of the developing roller 20.

Each process cartridge 17 houses toner of one of respective colors.

The toner in the process cartridge 17 is supplied to the supply roller 21, then to the developing roller 20. At this time, the toner is tribo-charged with positive polarity between the supply roller 21 and developing roller 20.

Then, as the developing roller 20 rotates, the toner on the developing roller 20 is regulated by the thickness regulation blade 22 and carried as a thin toner layer of a uniform thickness on a surface of the developing roller 20.

In the meantime, a surface of the photosensitive drum 18 is uniformly and positively charged by the charging roller 19 as the photosensitive drum 18 rotates. Then, the scanner unit 11 emits a laser beam to the charged surface of the photosensitive drum 18 to expose the surface of the photosensitive drum 18 to light. As a result, an electrostatic latent image corresponding to an image to be formed on the sheet P is formed on the surface of the photosensitive drum 18

As the photosensitive drum 18 further rotates, the toner carried on the surface of the developing roller 20 and having a positive polarity is supplied to the electrostatic latent image formed on the surface of the photosensitive drum 18. In this way, a toner image is formed on the surface of the photosensitive drum 18 through a reversal phenomenon.

(3-3) Transfer Unit

In the main casing 2, the transfer unit 13 is disposed above the sheet supply section 3 but below the drawer unit 12 within the main casing 2. The transfer unit 13 extends in the front-rear direction.

The transfer unit 13 includes a drive roller 23, a driven roller 24, the conveying belt 25, and four transfer rollers 26.

The drive roller 23 and driven roller 24 are arranged to be spaced apart from each other in the front-rear direction. The conveying belt 25 is mounted on and around the drive roller 23 and driven roller 24 in a tout state. Each of the four transfer rollers 26 is disposed to correspond to the corresponding one of the four photosensitive drums 18 such that an upper portion of the conveying belt 25 is interposed between each of the pairs of the transfer roller 26 and the photosensitive drum 18. Each pair of the transfer roller 26 and the photosensitive drum 18 defines a transfer position therebetween on the conveying belt 25.

The sheet P supplied from the sheet supply section 3 is conveyed by the conveying belt 25 conveys from the front side to rear side to sequentially passes through the four transfer positions. During passage of the sheet P through the transfer positions, the toner images of the respective colors carried on the respective photosensitive drums 18 are sequentially superimposed onto the sheet P to form a color image thereon.

(3-4) Fixing Unit

The fixing unit 14 is disposed rearward of the transfer unit 13. The fixing unit 14 includes a heating roller 29 and a pressure roller 30. The pressure roller 30 is disposed adjacent to the heating roller 29 to be positioned at a lower rear side of the heating roller 29.

As the sheet P passes between the heating roller 29 and pressure roller 30, the toner image transferred onto the sheet P is thermally fixed thereon due to application of heat and pressure by the heating roller 29 and pressure roller 30.

(4) Sheet Discharge Section

The sheet discharge section 5 is disposed above the fixing unit 14. The sheet discharge section 5 includes a discharge guide 29, a discharge port 30, a pair of discharge rollers 31, and a discharge tray 32.

The sheet P on which the toner image has been thermally fixed in the fixing unit 14 is fed upward and frontward while making a U-turn with a guide by the discharge guide 29. The sheet P then passes between the pair of discharge rollers 31, and is finally discharged onto the discharge tray 32 through the discharge port 30.

2. Drawer Unit

The drawer unit 12 includes the drawer frame 40 and the four process cartridges 17 detachably accommodated in the drawer frame 40.

(1) Drawer Frame

The drawer frame 40 is configured to support the four process cartridges 17 arranged in the front-rear direction. Further, the drawer frame 40 is configured to be slidable in the front-rear direction relative to the main casing 2. Specifically, the drawer frame 40 supporting the process cartridges 17 is capable of moving between the inner position at which the drawer unit 12 is attached to the main casing 2 and the outer position at which the drawer unit 12 is detached from the main casing 2 as described above.

Figure 3:
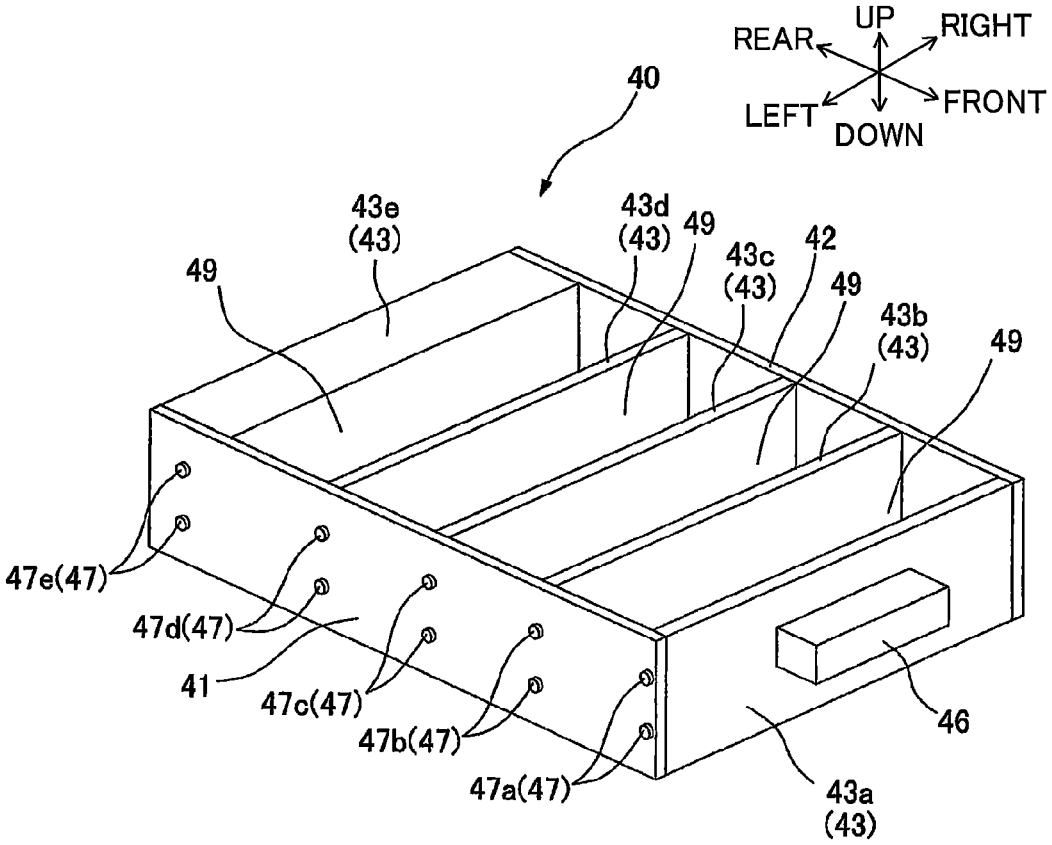
FIG. 3 is a perspective view of a drawer frame of the drawer unit according to the embodiment.
Figure 4:
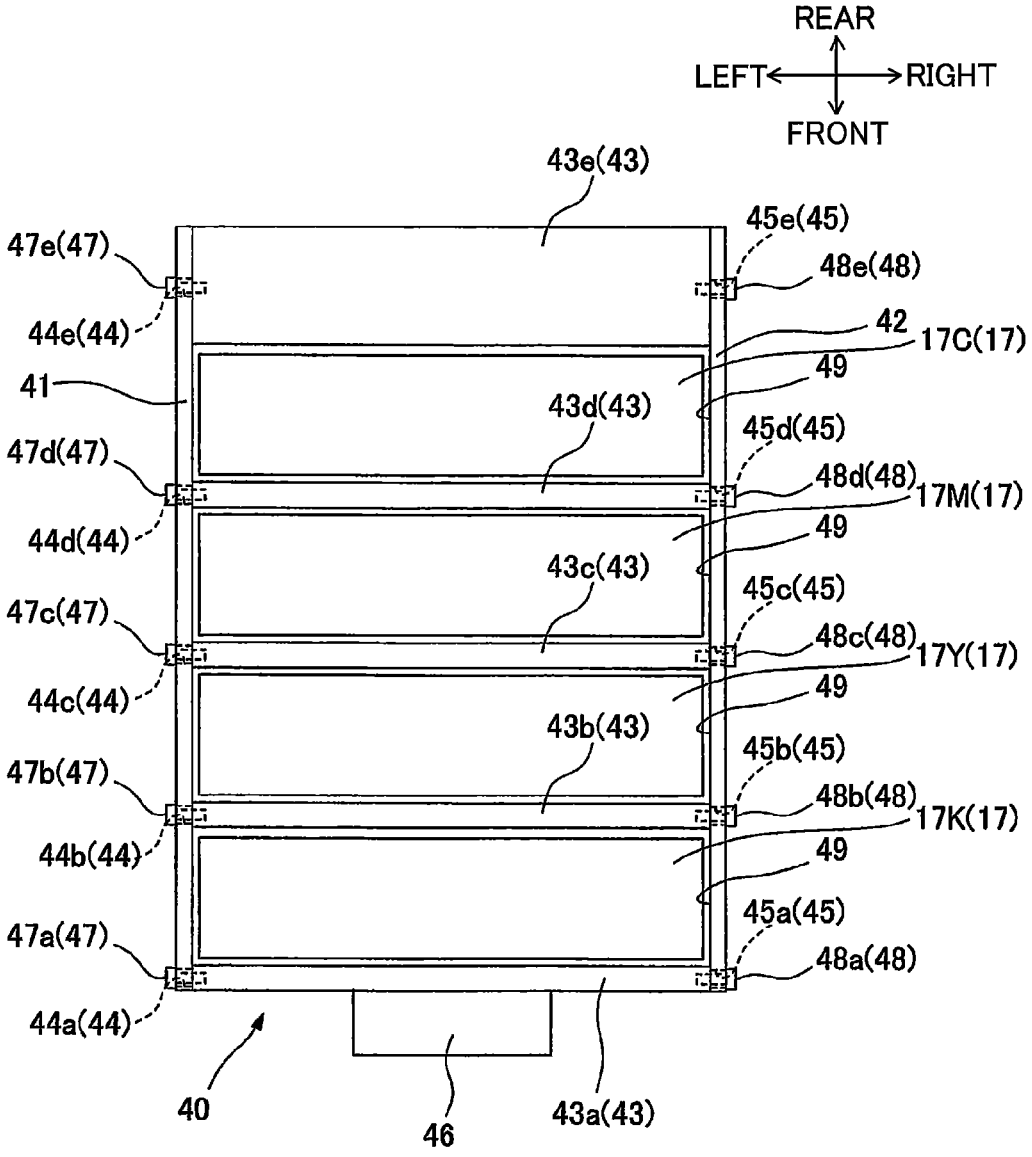
FIG. 4 is a plan view of the drawer unit according to the embodiment.

As illustrated in FIGS. 3 and 4, the drawer frame 40 includes a left side plate 41 and a right side plate 42 arranged to be spaced away from each other in the left-right direction, and five beam plates 43 connecting between the left side plate 41 and the right side plate 42 in the left-right direction. The left side plate 41 and right side plate 42 extend in the front-rear direction. The five beam plates 43 extend in the left-right direction and spans between the left and right side plates 41 and 42.

Figure 2:
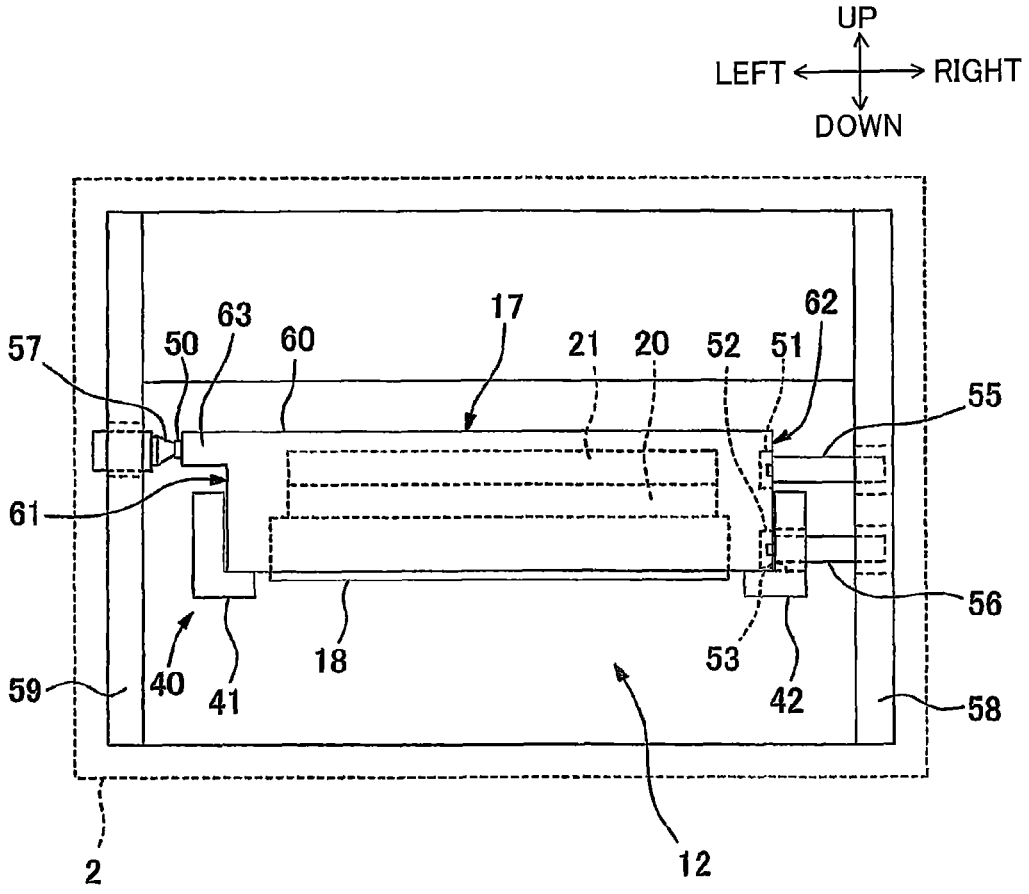
FIG. 2 is a schematic front cross-sectional view of the printer according to the embodiment accommodating the drawer unit.

The left side plate 41 is substantially rectangular flat plate shaped in a side view. Further, as shown in FIG. 2, the left side plate 41 has a bottom end portion that is bent rightward therefrom. The left side plate 41 thus has a substantially L-shape in a front view. As shown in FIGS. 3 and 4, the left side plate 41 has ten left insertion holes 44.

Each of the ten left insertion holes 44 penetrates the left side plate 41 in the left-right direction and is formed as a bored hole. The ten left insertion holes 44 can be grouped in five pairs in correspondence with the five beam plates 43. Specifically, the paired left insertion holes 44 (two left insertion holes 44 in each pair) are arranged vertically to be spaced away from each other in the up-down direction. The five pairs of the left insertion holes 44 are arranged at generally equi-intervals in the front-rear direction on the left side plate 41, i.e., one at the front end portion, another one at the rear end portion, and remaining three at three generally equally-distanced positions between the front end portion and the rear end portion, respectively.

More specifically, the one pair of the left insertion holes 44 formed at the front end portion of the left side plate 41 is referred to as front-left end insertion holes 44*a*. Another pair of the left insertion holes 44 formed at the rear end portion is referred to as rear-left end insertion holes 44*e*. The remaining three pairs of the left insertion holes 44 formed at generally regular intervals between the front and rear end portions of the left side plate 41 (between the front-left end insertion holes 44*a* and rear-left end insertion holes 44*e*) are referred to as front-left insertion holes 44*b*, center-left insertion holes 44*c* and rear-left insertion holes 44*d*, respectively. The front-left end insertion holes 44*a*, front-left insertion holes 44*b*, center-left insertion holes 44*c*, rear-left insertion holes 44*d* and rear-left end insertion holes 44*e* are arranged on the left side plate 41 in this order from the front in the front-rear direction.

Figure 6:
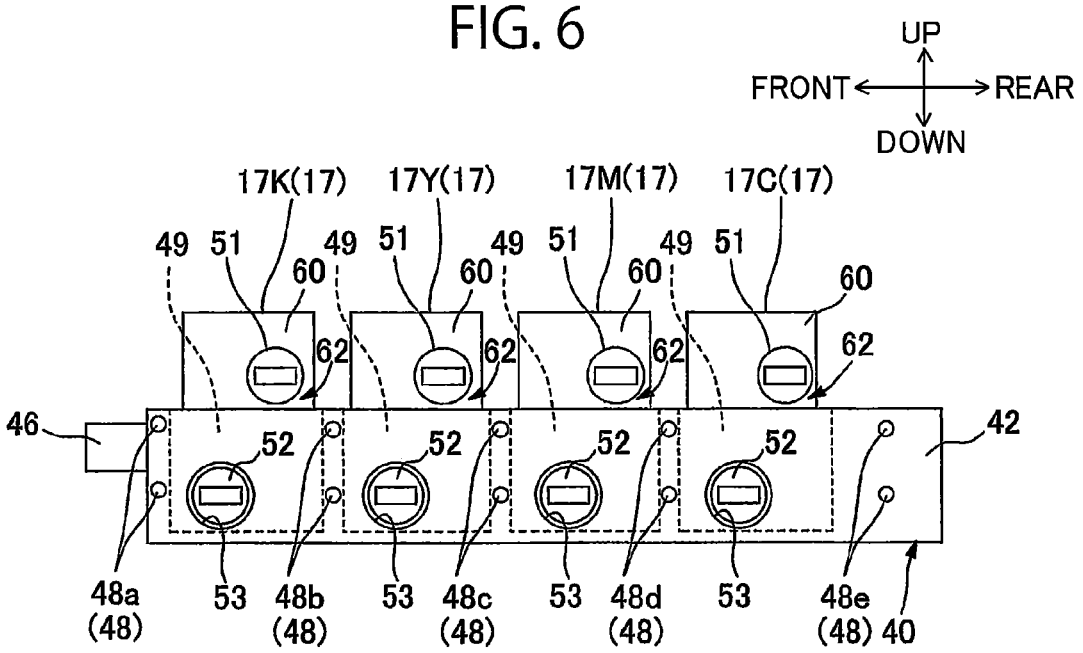
FIG. 6 is a right side view of the drawer unit according to the embodiment.

The right side plate 42 is substantially rectangular flat plate shaped in a side view. Further, as shown in FIG. 2, the right side plate 42 has a bottom end portion that is bent leftward therefrom. The right side plate 42 thus has a substantially L-shape in a front view. As shown in FIGS. 4 and 6, the right side plate 42 has ten right insertion holes 45 and four coupling holes 53.

Each of the ten right insertion holes 45 penetrates the right side plate 42 in the left-right direction and is formed as a bored hole. The ten right insertion holes 45 are grouped in five pairs in correspondence with the five beam plates 43. Specifically, the paired right insertion holes 45 (two right insertion holes 45 in each pair) are arranged vertically to be spaced away from each other in the up-down direction. The five pairs of the right insertion holes 45 are arranged at generally equi-intervals in the front-rear direction on the right side plate 42, i.e., one at the front end portion, another one at the rear end portion, and remaining three at three generally equally-distanced positions between the front end portion and the rear end portion, respectively.

More specifically, the one pair of the right insertion holes 45 formed at the front end portion of the right side plate 42 is referred to as front-right end insertion holes 45*a*. Another pair of the right insertion holes 45 formed at the rear end portion is referred to as rear-right end insertion holes 45*e*. The remaining three pairs of the right insertion holes 45 formed at generally regular intervals between the front and rear end portions of the right side plate 42 (between the front-right end insertion holes 45*a* and rear-right end insertion holes 45*e*) are referred to as front-right insertion holes 45*b*, center-right insertion holes 45*c* and rear-right insertion holes 45*d*, respectively. The front-right end insertion holes 45*a*, front-right insertion holes 45*b*, center-right insertion holes 45*c*, rear-right insertion holes 45*d* and rear-right end insertion holes 45*e* are arranged on the right side plate 42 in this order from the front in the front-rear direction.

Each of the four coupling holes 53 is formed as a bored hole and penetrates a lower portion of the right side plate 42 in the left-right direction. The coupling holes 53 are arranged on the right side plate 42 to be spaced away from one another in the front-rear direction and to correspond to the four photosensitive drums 18, respectively. Specifically, each coupling hole 53 is positioned on the lower portion of the right side plate 42 between adjacent pairs of the right insertion holes 45.

The left side plate 41 and right side plate 42 are formed of the same steel sheet material (e.g., SECC) and have the same linear expansion coefficient as each other (e.g., $12\times10^{-6}/^{\circ}$ C.).

The five beam plates 43 include, from the front to rear, a front beam 43*a*, a front partition beam 43*b*, a center partition beam 43*c*, a rear partition beam 43*d*, and a rear beam 43*e*.

The front beam 43*a* is a flat plate having a substantially rectangular shape extending in the left-right direction in a front view. The front beam 43*a* is positioned to span between the pair of front-left end insertion holes 44*a* of the left side plate 41 and pair of front-right end insertion holes 45*a* of the right side plate 42. The front beam 43*a* has a front surface on which a gripping part 46 is provided to protrude frontward therefrom at a generally left-right center thereof. Although not illustrated, the front beam 43*a* has a left end face in which a pair of screw grooves is formed to correspond to the pair of front-left end insertion holes 44*a*. Similarly, the front beam 43*a* has a right end surface in which a pair of screw grooves is formed to correspond to the pair of front-right end insertion holes 45*a*.

The front partition beam 43*b* is a flat plate having a substantially rectangular shape extending in the left-right direction in a front view. The front partition beam 43*b* is positioned to span between the pair of front-left insertion holes 44*b* of the left side plate 41 and pair of front-right insertion holes 45*b* of the right side plate 42. Although not illustrated, the front partition beam 43*b* has left and right end faces in each of which a pair of screw grooves is formed to correspond to the pair of front-left insertion holes 44*b* and the front-right insertion holes 45*b*, respectively.

The center partition beam 43*c* is a flat plate having a substantially rectangular shape extending in the left-right direction in a front view. The center partition beam 43*c* is positioned to span between the pair of center-left insertion holes 44*c* of the left side plate 41 and pair of center-right insertion holes 45*c* of the right side plate 42. Although not illustrated, the center partition beam 43*c* has left and right end faces in each of which a pair of screw grooves is formed to correspond to the pair of center-left insertion holes 44*c* and the center-right insertion holes 45*c*, respectively.

The rear partition beam 43*d* is a flat plate having a substantially rectangular shape extending in the left-right direction in a front view. The rear partition beam 43*d* is positioned to span between the pair of rear-left insertion holes 44*d* of the left side plate 41 and pair of rear-right insertion holes 45*d* of the right side plate 42. Although not illustrated, the rear partition beam 43*d* has left and right end faces in each of which a pair of screw grooves is formed to correspond to the pair of rear-left insertion holes 44*d* and the rear-right insertion holes 45*d*, respectively.

The rear beam 43*e* is a flat plate having a substantially rectangular shape extending in the left-right direction in a front view. The rear beam 43*e* is positioned to span between the pair of rear-left end insertion holes 44*e* of the left side plate 41 and pair of rear-right end insertion holes 45*e* of the right side plate 42. The rear beam 43*e* has a thickness larger than those of the front beam 43*a*, front partition beam 43*b*, center partition beam 43*c*, and rear partition beam 43*d* in the front-rear direction. Although not illustrated, the rear beam 43*e* has left and right end faces in each of which a pair of screw grooves is formed to correspond to the pair of rear-left end insertion holes 44*e* and the rear-right end insertion holes 45*e*, respectively.

The front beam 43*a*, front partition beam 43*b*, center partition beam 43*c*, rear partition beam 43*d*, and rear beam 43*e* are formed of the same resin material (e.g., ABS) and have the same linear expansion coefficient as one another. For example, the linear expansion coefficient could be $80\times10^{-6}/°$ C.

The drawer frame 40 includes ten left fastening screws 47 and ten right fastening screws 48 for fastening the five beam plates 43 to each of the left and right side plates 41 and 42. Each beam plates 43 is fastened to the left side plate 41 by the left fastening screws 47 and to the right side plate 42 by the right fastening screws 48.

Specifically, front-left end fastening screws 47*a* are respectively inserted into the front-left end insertion holes 44*a* of the left side plate 41, and then screwed into the screw grooves of the front beam 43*a*. The front beam 43*a* is thus screw-fixed to the left side plate 41.

Front-left fastening screws 47*b* are respectively inserted into the front-left insertion holes 44*b* of the left side plate 41 and then screwed into the screw grooves of the front partition beam 43*b*. The front partition beam 43*b* is thus screw-fixed to the left side plate 41.

Center-left fastening screws 47*c* are respectively inserted into the center-left insertion holes 44*c* of the left side plate 41 and then screwed into the screw grooves of the center partition beam 43*c*. The center partition beam 43*c* is thus screw-fixed to the left side plate 41.

Rear-left fastening screws 47*d* are respectively inserted into the rear-left insertion holes 44*d* of the left side plate 41 and then screwed into the screw grooves of the rear partition beam 43*d*. The rear partition beam 43*d* is thus screw-fixed to the left side plate 41.

Rear-left end fastening screws 47*e* are respectively inserted into the rear-left end insertion holes 44*e* of the left side plate 41 and then screwed into the screw grooves of the rear beam 43*e*. The rear beam 43*e* is thus crew-fixed to the left side plate 41.

Similarly, in the right side plate 42, front-right end fastening screws 48*a* are inserted into the front-right end insertion holes 45*a* of the right side plate 42 and screwed into the screw grooves of the front beam 43*a*, respectively. The front beam 43*a* is thus screw-fixed to the right side plate 42.

Front-right fastening screws 48*b* are inserted into the front-right insertion holes 45*b* of the right side plate 42 and screwed into the screw grooves of the front partition beam 43*b*, respectively. The front partition beam 43*b* is thus screw-fixed to the right side plate 42.

Center-right fastening screws 48*c* are inserted into the center-right insertion holes 45*c* of the right side plate 42 and screwed into the screw grooves of the center partition beam 43*c*. The center partition beam 43*c* is thus screw-fixed to the right side plate 42.

Rear-right fastening screws 48*d* are inserted into the rear-right insertion holes 45*d* of the right side plate 42 and screwed into the screw grooves of the rear partition beam 43*d*. The rear partition beam 43*d* is thus screw-fixed to the right side plate 42.

Rear-right end fastening screws 48*e* are inserted into the rear-right end insertion holes 45*e* of the right side plate 42 and screwed into the screw grooves of the rear beam 43*e*. The rear beam 43*e* is thus screw-fixed to the right side plate 42.

With the above configuration, in the drawer frame 40, the left side plate 41, right side plate 42, and the five beam plates 43 define four spaces, i.e., four cartridge housing spaces 49 extending in the left-right direction. Specifically, as shown in FIGS. 3 and 4, the four cartridge housing spaces 49 includes: a space for housing a black process cartridge 17K; a space for housing a yellow process cartridge 17Y; a space for housing a magenta process cartridge 17M; and a space for housing a cyan process cartridge 17C, from the front to rear.

(2) Process Cartridge

Each process cartridge 17 includes a cartridge frame 60.

As illustrated in FIGS. 1 and 2, the cartridge frame 60 has a substantially box-like shape extending in the left-right direction and having a lower end portion that is open downward. The cartridge frame 60 supports the photosensitive drum 18, charging roller 19, developing roller 20, supply roller 21, and thickness regulation blade 22. The cartridge frame 60 is made of a resin material. More specifically, the cartridge frame 60 is formed of the same resin material as that of the beam plate 43 and has the same linear expansion coefficient as that of the beam plate 43.

The cartridge frame 60 has a left side surface on which an electrode section 61 is provided, and a right side surface in which a power input section 62 is provided.

The electrode section 61 includes a base portion 63 and a cartridge-side electrode 50. The base portion 63 protrudes leftward from an upper end portion of the left side surface of the cartridge frame 60 and has a substantially rectangular shape in a left side view.

Figure 5:
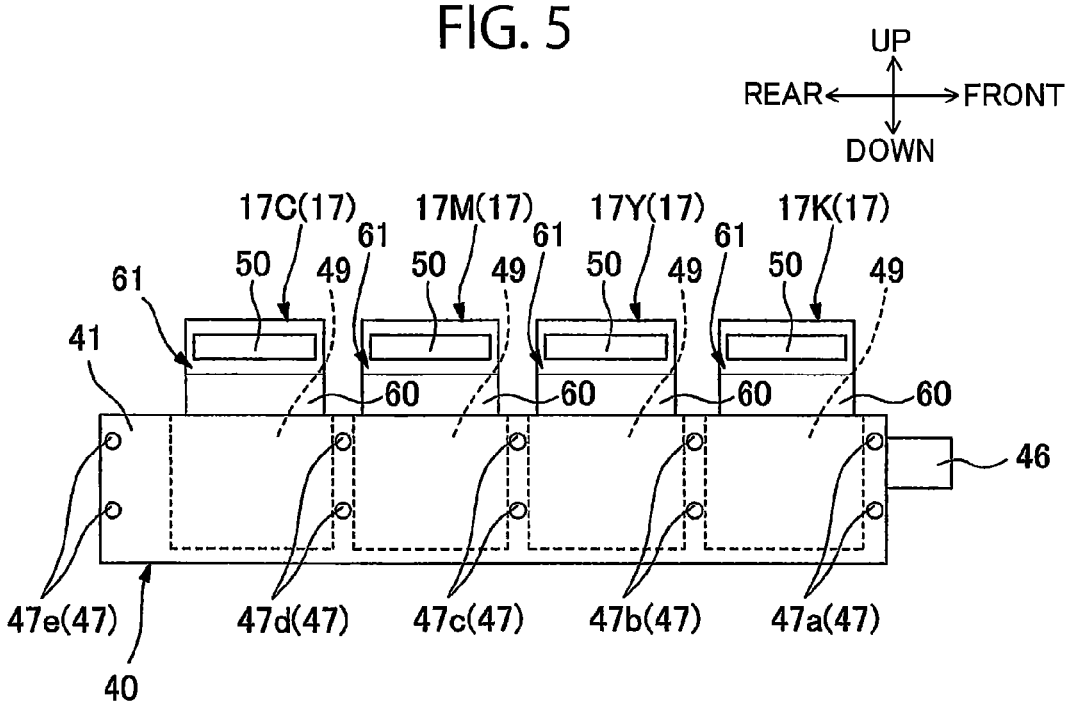
FIG. 5 is a left side view of the drawer unit according to the embodiment.

The cartridge-side electrode 50 is positioned on the base portion 63. Specifically, as illustrated in FIGS. 2 and 5, the cartridge-side electrode 50 protrudes leftward from the base portion 63. This structure allows the cartridge-side electrode 50 to be electrically connected to a body-side electrode 57 (described later). Further, the cartridge-side electrode 50 is electrically connected to the photosensitive drum 18, charging roller 19, developing roller 20, and supply roller 21.

The power input section 62 includes a developing coupling 51 and a drum coupling 52, as illustrated in FIGS. 2 and 6.

The developing coupling 51 is positioned at an upper rear portion of the right side surface of the process cartridge 17. The developing coupling 51 has a substantially disk shape with a substantially rectangular-shaped groove formed at its vertical center in a right side view. The developing coupling 51 is mechanically connected to the charging roller 19, developing roller 20, and supply roller 21 through a not illustrated gear train so as to be able to transmit drive force thereto.

The drum coupling 52 is positioned at a lower front portion of the right side surface of the process cartridge 17. The drum coupling 52 has a substantially disk shape having a substantially rectangular groove at its vertical center in a right side view. The drum coupling 52 is mechanically connected to the photosensitive drum 18 so as to be able to transmit drive force thereto.

When the process cartridges 17 are respectively housed in the corresponding cartridge housing spaces 49 of the drawer frame 40, the respective bottom end portions of the left and right side plates 41, 42 (the portions bending inward in the left-right direction) support the process cartridges 17, whereby the process cartridges 17 are supported by the drawer frame 40, as shown in FIG. 2. In this state, as shown in FIG. 4, the center partition beam 43*c* extending in the left-right direction is positioned between the left side plate 41 and right side plate 42 in the left-right direction. In the front-rear direction, the center partition beam 43*c* is interposed between the yellow and magenta process cartridges 17Y and 17M extending in the left-right direction.

The front partition beam 43*b* is positioned opposite to the center partition beam 43*c* with respect to the yellow process cartridge 17Y in the front-rear direction. The front partition beam 43*b* is positioned to extend in the left-right direction between the left side plate 41 and right side plate 42.

The rear partition beam 43*d* is positioned opposite to the center partition beam 43*c* with respect to the magenta process cartridge 17M in the front-rear direction. The rear partition beam 43*d* is positioned to extend in the left-right direction between the left side plate 41 and right side plate 42.

As illustrated in FIGS. 5 and 6, when the process cartridges 17 are supported in the drawer frame 40, an upper portion of each of the process cartridges 17 is positioned higher than upper edge portions of the left and right side plates 41 and 42. Thus, the cartridge side electrodes 50 and developing couplings 51 are positioned higher than the upper edge portions of the left and right side plates 41 and 42 in the up-down direction. Further, the drum couplings 52 are positioned to be aligned with the coupling holes 53, respectively, in the left-right direction (also see FIG. 2).

3. Main Casing

As illustrated in FIG. 2, the main casing 2 includes a right wall 58 and a left wall 59.

When the drawer frame 40 is at the inner position, the right and left walls 58 and 59 constitute a pair of side walls disposed and spaced away from each other in the left-right direction across the drawer frame 40.

The right and left walls 58 and 59 are formed of the same steel sheet material and have the same linear expansion coefficient as each other. Specifically, the right and left walls 58 and 59 are formed of the same steel sheet material as the left and right side plates 41 and 42 and thus have the linear expansion coefficient identical to those of the left and right side plates 41 and 42.

The right wall 58 includes four developing drive-force input shafts 55 and four drum drive-force input shafts 56.

The four developing drive-force input shafts 55 are provided to correspond to the four developing couplings 51, respectively. The developing drive-force input shafts 55 are configured to advance and retreat in the left-right direction in conjunction with opening and closing of the front cover 7.

The four drum drive-force input shafts 56 are provided to correspond to the four drum couplings 52, respectively. The drum drive-force input shafts 56 are configured to advance and retreat in the left-right direction in conjunction with opening and closing of the front cover 7.

When the drawer frame 40 is at the inner position with the front cover 7 being closed, the developing drive-force input shafts 55 positioned to the right of the drawer frame 40 advance leftward and are coupled to the developing couplings 51, respectively. Hence, through each of the developing couplings 51, each of the developing drive-force input shafts 55 can transmit drive force to the charging roller 19, developing roller 20, and supply roller 21 supported in each process cartridge 17. Likewise, the drum drive-force input shafts 56 positioned to the right of the drawer frame 40 are advanced leftward and are coupled to the respective drum couplings 52 through the corresponding coupling holes 53. With this configuration, each of the drum drive-force input shafts 56 can transmit drive force to the photosensitive drum 18 supported in each of the process cartridges 17 through each drum coupling 52.

When the drawer frame 40 is at the inner position but the front cover 7 is opened, the developing drive-force input shafts 55 retreat rightward from the respective developing couplings 51. Likewise, the drum drive-force input shafts 56 retreat rearward from the respective drum couplings 52. At this time, the drawer frame 40 is permitted to move from the inner position to outer position.

The left wall 59 includes four body-side electrodes 57.

The four body-side electrodes 57 are provided to correspond to the four cartridge-side electrodes 50, respectively.

When the drawer frame 40 is at the inner position, the body-side electrodes 57 are positioned to the left of the drawer frame 40 to be in contact with the cartridge-side electrode 50, respectively. With this configuration, each of the body-side electrodes 57 supplies power to the photosensitive drum 18, charging roller 19, developing roller 20, and supply roller 21 supported in each process cartridge 17 through each of the cartridge-side electrodes 50.

4. Operational and Technical Advantages (1) According to the printer 1 of the above-described embodiment, the beam plates 43, left side plate 41, and right side plate 42 are provided as separate members. Hence, the beam plates 43, left side plate 41, and right side plate 42 can each be suitably designed independently in accordance with their individual configurations and/or needs. Further, since the beam plates 43 are fastened to the left and right side plates 41 and 42 by the left and right fastening screws 47 and 48, enhanced rigidity of the drawer frame 40 can be obtained. In particular, the front partition beam 43*b*, the center partition beam 43*c* and the rear partition beam 43*d* are respectively fastened to the left and right side plates 41 and 42 by the front-left fastening screws 47*b* and front-right fastening screws 48*b*, by the center-left fastening screws 47*c* and center-right fastening screws 48*c*, and by the rear-left fastening screws 47*d* and rear-right fastening screws 48*d*, respectively. Rigidity of the drawer frame 40 can be further enhanced.

Further, the beam plates 43, left side plate 41, and right side plate 42 are molded independently of one another. Hence, compared to a case where the beam plates 43, left side plate 41, and right side plate 42 are integrally molded, a die for molding each of the above plates 43, 41, 42 can be compact. Thus, the drawer frame 40 can be produced at a lower cost.

(2) Further, the five beam plates 43 have the same liner expansion coefficient as one another. Thus, the beam plates 43 can expand or contract at a rate substantially the same as one another in response to a temperature change, leading to suppression of distortion attributed to temperature changes. As a result, deformation of the drawer frame 40 can be restrained.

(3) Further, all the beam plates 43 are formed of the same material. Thus, rigidity of the beam plates 43 can be made uniform, thereby resulting in enhancement of rigidity of the drawer frame 40.

(4) Further, the beam plates 43 are all formed of the same resin material. Thus, the beam plates 43 can be easily molded and produced at a lower cost.

(5) Further, the beam plates 43 have the same linear expansion coefficient as those of the cartridge frames 60. Thus, in response to a change in temperature, the beam plates 43 can change in length at the substantially same rate as the cartridge frames 60 change in length. This configuration can mitigate changes in gap between the beam plates 43 and cartridge frames 60 in response to changes in temperature. As a result, a gap between the beam plates 43 and cartridge frames 60 can also be made smaller, thereby restricting occurrence of backlash therebetween.

(6) Further, the left and right side plates 41 and 42 have the same liner expansion coefficient as each other. Thus, the left and right side plates 41 and 42 can expand or contract at a rate substantially the same as each other in response to a temperature change, thereby restricting distortion in the left and right side plates 41 and 42 from occurring attributed to temperature changes.

(7) Further, the left and right side plates 41 and 42 are formed of the same material as each other. Thus, rigidity of the left and right side plates 41 and 42 can be made uniform, thereby resulting in enhancement of rigidity of the drawer frame 40.

(8) Further, the left and right side plates 41 and 42 are formed of the same metal steel plate. Thus, rigidity of the left and right side plates 41 and 42 can be made enhanced.

(9) Further, according to the printer 1, when the drawer frame 40 is in the inner position, the right and left walls 58, 59 oppose and are spaced away from each other in the left-right direction via the drawer frame 40. Such right and left walls 58, 59 have the same linear expansion coefficient as those of the left and right side plates 41 and 42.

This means that the right and left walls 58, 59 and the left and right side plates 41, 42 can change in length at substantially the same rate as one another in response to changes in temperature. Thus, this configuration can serve to reduce occurrence of expansion/contraction between the right and left walls 58, 59 and the left and right side plates 41, 42. As a result, backlash of the drawer frame 40 relative to the main casing 2 can be suppressed.

5. Variations and Modifications (1) In the printer 1, the yellow process cartridge 17Y and the magenta process cartridge 17M are examples of claimed first and second cartridges. However, the magenta process cartridge 17M may be an example of the claimed first cartridge and the yellow process cartridge 17Y may be an example of the claimed second cartridge. In this case, the center partition beam 43*c* corresponds to the claimed first beam member, while the rear partition beam 43*d* and front partition beam 43*b* correspond to the claimed second beam member and the third beam member, respectively.

(2) The black process cartridge 17K may be an example of the claimed first cartridge and the yellow process cartridge 17Y may be an example of the claimed second cartridge. In this case, the front partition beam 43*b* corresponds to the claimed first beam member, while the front beam 43*a* and center partition beam 43*c* correspond to the claimed second beam member and the third beam member, respectively.

(3) The yellow process cartridge 17Y may be an example of the claimed first cartridge and the black process cartridge 17K may be an example of the claimed second cartridge. In this case, the front partition beam 43*b* corresponds to the claimed first beam member, while the center partition beam 43*c* and front beam 43*a* correspond to the claimed second beam member and the third beam member, respectively.

(4) The cyan process cartridge 17C may be an example of the claimed first cartridge and the magenta process cartridge 17M may be an example of the claimed second cartridge. In this case, the rear partition beam 43*d* corresponds to the claimed first beam member, while the rear beam 43*e* and center partition beam 43*c* correspond to the claimed second beam member and the third beam member, respectively.

(5) The magenta process cartridge 17M may be an example of the claimed first cartridge and the cyan process cartridge 17C may be an example of the claimed second cartridge. In this case, the rear partition beam 43*d* corresponds to the claimed first beam member, while the center partition beam 43*c* and rear beam 43*e* correspond to the claimed second beam member and the third beam member, respectively.

(6) Further, each of the claimed first and second cartridges may include more than one cartridge.

For example, the black process cartridge 17K and the magenta process cartridge 17M may be examples of the claimed first cartridge, while the yellow process cartridge 17Y and the cyan process cartridge 17C may be examples of the claimed second cartridges. In this case, focusing the black process cartridge 17K and yellow process cartridge 17Y, the front partition beam 43*b* corresponds to the claimed first beam member, while the front beam 43*a* and the center partition beam 43*c* correspond to the claimed second beam member and the third beam member, respectively. Similarly, focusing on the magenta process cartridge 17M and the cyan process cartridge 17C, the rear partition beam 43*d* corresponds to the claimed first beam member, while the center partition beam 43*c* and the rear beam 43*e* correspond to the claimed second beam member and the third beam member, respectively.

In other words, the center partition beam 43*c* corresponds to the claimed third beam member if the black process cartridge 17K and the yellow process cartridge 17Y are considered, whereas the center partition beam 43*c* corresponds to the claimed second beam member if the magenta process cartridge 17M and the cyan process cartridge 17C are considered.

(7) The yellow process cartridge 17Y and the cyan process cartridge 17C may be examples of the claimed first cartridge, while the black process cartridge 17K and the magenta process cartridge 17M may be examples of the claimed second cartridges. In this case, focusing the black process cartridge 17K and yellow process cartridge 17Y, the front partition beam 43*b* corresponds to the claimed first beam member, while the center partition beam 43*c* and the front beam 43*a* correspond to the claimed second beam member and the third beam member, respectively. Similarly, focusing on the magenta process cartridge 17M and the cyan process cartridge 17C, the rear partition beam 43*d* corresponds to the claimed first beam member, while the center rear beam 43*e* and the center partition beam 43*c* correspond to the claimed second beam member and the third beam member, respectively.

In other words, the center partition beam 43*c* corresponds to the claimed second beam member if the black process cartridge 17K and the yellow process cartridge 17Y are considered, whereas the center partition beam 43*c* corresponds to the claimed third beam member if the magenta process cartridge 17M and the cyan process cartridge 17C are considered.

(8) The black process cartridge 17K and the cyan process cartridge 17C may be examples of the claimed first cartridge, while the yellow process cartridge 17Y and the magenta process cartridge 17M may be examples of the claimed second cartridges. In this case, focusing the black process cartridge 17K and yellow process cartridge 17Y, the front partition beam 43*b* corresponds to the claimed first beam member, while the front beam 43*a* and the center partition beam 43*c* correspond to the claimed second beam member and the third beam member, respectively. Similarly, focusing on the magenta process cartridge 17M and the cyan process cartridge 17C, the rear partition beam 43*d* corresponds to the claimed first beam member, while the center rear beam 43*e* and the center partition beam 43*c* correspond to the claimed second beam member and the third beam member, respectively.

In other words, the center partition beam 43*c* corresponds to the claimed third beam member if the black process cartridge 17K and the yellow process cartridge 17Y are considered, whereas the center partition beam 43*c* corresponds to the claimed third beam member if the magenta process cartridge 17M and the cyan process cartridge 17C are considered.

(9) The yellow process cartridge 17Y and the magenta process cartridge 17M may be examples of the claimed first cartridge, while the black process cartridge 17K and the cyan process cartridge 17C may be examples of the claimed second cartridges. In this case, focusing the black process cartridge 17K and yellow process cartridge 17Y, the front partition beam 43*b* corresponds to the claimed first beam member, while the center partition beam 43*c* and the front beam 43*a* correspond to the claimed second beam member and the third beam member, respectively. Similarly, focusing on the magenta process cartridge 17M and the cyan process cartridge 17C, the rear partition beam 43*d* corresponds to the claimed first beam member, while the center partition beam 43*c* and the center rear beam 43*e* correspond to the claimed second beam member and the third beam member, respectively.

In other words, the center partition beam 43*c* corresponds to the claimed second beam member if the black process cartridge 17K and the yellow process cartridge 17Y are considered, whereas the center partition beam 43*c* corresponds to the claimed second beam member if the magenta process cartridge 17M and the cyan process cartridge 17C are considered.

(10) The beam plates 43 may not be formed of a resin, but may be formed of a metal steel sheet. This configuration lead to further enhancement of rigidity of the beam plates 43.

(11) If the beams plates 43 are formed of the same steel sheet material as the left and right side plates 41 and 42, the beam plates 43 may have the same linear expansion coefficient as the left and right side plates 41 and 42.

With this configuration, the left and right side plates 41, 42 and beam plates 43 can change in length at substantially the same rate in response to a temperature change, so that distortion attributed to a temperature change can be suppressed. Further, expansion/contraction between the beam plates 43 and each of the left and right side plates 41, 42 can be suppressed from occurring. As a result, backlash of the left and right side plates 41 and 42 relative to the beam plates 43 can be suppressed.

(12) In the printer 1, the left and right side plates 41 and 42 are formed of a metal steel sheet. However, the left side plate 41 may be formed of a glass-fiber reinforced resin and the right side plate 42 may be formed of a metal steel sheet.

When the body-side electrode 57 and cartridge-side electrode 50 are brought into contact with each other, it is likely that either one of the body-side electrode 57 and cartridge-side electrode 50 may also contact the left side plate 41. However, if the left side plate 41 is made of a glass-fiber reinforced resin, electrical leakage to the left side plate 41 can be suppressed even if either one of the body-side electrode 57 and cartridge-side electrode 50 contacts the left side plate 41. Thus, leakage of electricity to the left side plate 41 can be prevented, while rigidity of the drawer frame 40 is enhanced by the right side plate 42.

(13) The beam plates 43 are screw-fixed to the left and right side plates 41 and 42 by the left and right fastening screws 47 and 48 in the depicted embodiment. However, the beam plates 43 may be fastened by welding to the left and right side plates 41 and 42.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a main casing;

a first cartridge extending in a first direction and configured to accommodate developer;

a second cartridge extending in the first direction and configured to accommodate developer;

a supporting member configured to support the first cartridge and the second cartridge such that the first cartridge and the second cartridge are arranged in a second direction generally perpendicular to the first direction, the supporting member being configured to move between an inner position disposed within the main casing and an outer position disposed outside of the main casing in the second direction, the supporting member comprising:

a first side plate extending in the second direction, the first side plate having a first upper hole and a first lower hole spaced away from each other in an up-down direction perpendicular to both the first direction and the second direction, the first side plate being a single member;

a second side plate extending in the second direction and positioned opposite the first side plate to be spaced away therefrom in the first direction, the second side plate having a second upper hole and a second lower hole spaced away from each other in the up-down direction, the second side plate being a single member;

a first beam plate interposed between the first cartridge and the second cartridge in the second direction when the supporting member supports the first cartridge and the second cartridge, the first beam plate extending in the first direction between the first side plate and the second side plate, the first beam plate being a flat plate and including a first upper groove corresponding to the first upper hole, a first lower groove corresponding to the first lower hole, a second upper groove corresponding to the second upper hole, and a second lower groove corresponding to the second lower hole;

a first upper screw inserted into both the first upper hole of the first side plate and the first upper groove of the first beam plate;

a first lower screw inserted into both the first lower hole of the first side plate and the first lower groove of the first beam plate, the first upper screw and the first lower screw directly fastening the first beam plate to the first side plate;

a second upper screw inserted into both the second upper hole of the second side plate and the second upper groove of the first beam plate; and a second lower screw inserted into both the second lower hole of the second side plate and the second lower groove of the first beam plate, the second upper screw and the second lower screw directly fastening the first beam plate to the second side plate, wherein an uppermost surface of the first beam plate is flush with an uppermost surface of the first side plate and an uppermost surface of the second side plate.

2. The image forming apparatus as recited in claim 1, wherein the supporting member further comprises:

a second beam plate positioned opposite the first beam plate with respect to the first cartridge when the supporting member supports the first cartridge and the second cartridge, the second beam plate extending in the first direction between the first side plate and the second side plate, the first side plate further having a third upper hole and a third lower hole spaced away from each other in the up-down direction, the second side plate further having a fourth upper hole and a fourth lower hole spaced away from each other in the up-down direction, the second beam plate being a flat plate and including a third upper groove corresponding to the third upper hole, a third lower groove corresponding to the third lower hole, a fourth upper groove corresponding to the fourth upper hole, and a fourth lower groove corresponding to the fourth lower hole;

a third upper screw inserted into the third upper hole of the first side plate and the third upper groove of the second beam plate;

a third lower screw inserted into the third lower hole of the first side plate and the third lower groove of the second beam plate, the third upper screw and the third lower screw directly fastening the second beam plate to the first side plate;

a fourth upper screw inserted into the fourth upper hole of the second side plate and the fourth upper groove of the second beam plate; and a fourth lower screw inserted into the fourth lower hole of the second side plate and the fourth lower groove of the second beam plate, the fourth upper screw and the fourth lower screw directly fastening the second beam plate to the second side plate.

3. The image forming apparatus as recited in claim 2, wherein the supporting member further comprises:

a third beam plate positioned opposite the first beam plate with respect to the second cartridge when the supporting member supports the first cartridge and the second cartridge, the third beam plate extending in the first direction between the first side plate and the second side plate, the first side plate further having a fifth upper hole and a fifth lower hole spaced away from each other in the up-down direction, the second side plate further having a sixth upper hole and a sixth lower hole spaced away from each other in the up-down direction, the third beam plate being a flat plate and including a fifth upper groove corresponding to the fifth upper hole, a fifth lower groove corresponding to the fifth lower hole, a sixth upper groove corresponding to the sixth upper hole, and a sixth lower groove corresponding to the sixth lower hole;

a fifth upper screw inserted into the fifth upper hole of the first side plate and the fifth upper groove of the third beam plate;

a fifth lower screw inserted into the fifth lower hole of the first side plate and the fifth lower groove of the third beam plate, the fifth upper screw and the fifth lower screw directly fastening the third beam plate to the first side plate;

a sixth upper screw inserted into the sixth upper hole of the second side plate and the sixth upper groove of the third beam plate; and a sixth lower screw inserted into the sixth lower hole of the second side plate and the sixth lower groove of the third beam plate, the sixth upper screw and the sixth lower screw directly fastening the third beam plate to the second side plate.

4. The image forming apparatus as recited in claim 3, wherein the first beam plate, the second beam plate and the third beam plate have substantially the same linear expansion coefficient as one another.

5. The image forming apparatus as recited in claim 4, wherein the first beam plate, the second beam plate and the third beam plate are made of a material substantially the same as one another.

6. The image forming apparatus as recited in claim 4, wherein the first beam plate, the second beam plate and the third beam plate are made of a resin.

7. The image forming apparatus as recited in claim 4, wherein the first beam plate, the second beam plate and the third beam plate are made of a metal.

8. The image forming apparatus as recited in claim 3, wherein the first cartridge includes a first frame configured to support a first processing body for forming an image and the second cartridge includes a second frame configured to support a second processing body for forming an image; and wherein the first beam plate, the second beam plate and the third beam plate have a linear expansion coefficient substantially identical to a linear expansion coefficient of the first frame and the second frame.

9. The image forming apparatus as recited in claim 1, wherein the first side plate and the second side plate have substantially the same linear expansion coefficient as each other.

10. The image forming apparatus as recited in claim 9, wherein the first side plate and the second side plate are made of a material substantially the same as each other.

11. The image forming apparatus as recited in claim 9, wherein the first side plate and the second side plate are made of a metal.

12. The image forming apparatus as recited in claim 9, wherein the first side plate and the second side plate have a linear expansion coefficient substantially identical to a linear expansion coefficient of the first beam plate.

13. The image forming apparatus as recited in claim 9, wherein the main casing further comprises a pair of side walls disposed in opposition to and in separation from each other in the first direction with the supporting member at the inner position interposed between the side walls; and wherein one of the first side plate and the second side plate has a linear expansion coefficient substantially identical to a linear expansion coefficient of the pair of side walls.

14. The image forming apparatus as recited in claim 1, wherein the main casing further comprises a first body-side electrode and a second body-side electrode associated with the first cartridge and the second cartridge respectively;

wherein the first cartridge comprises a first cartridge electrode configured to supply power to a first processing body for forming an image and the second cartridge comprises a second cartridge electrode configured to supply power to a second processing body for forming an image, the first cartridge electrode and the second cartridge electrode being configured to contact the first body-side electrode and the second body-side electrode respectively and to receive power therefrom when the supporting member supports the first cartridge and the second cartridge and is located at the inner position;

wherein the first side plate is positioned adjacent to the first body-side electrode and the second body-side electrode in the first direction when the supporting member supports the first cartridge and the second cartridge and is located at the inner position, the first side plate being made of a glass-fiber reinforced resin; and wherein the second side plate is positioned away from the first body-side electrode and the second body-side electrode in the first direction when the supporting member supports the first cartridge and the second cartridge and is located at the inner position, the second side plate being made of a metal.

15. The image forming apparatus as recited in claim 1, wherein the first beam plate has a substantially rectangular shape when viewed in the second direction.

16. The image forming apparatus as recited in claim 1, further comprising a second beam plate positioned opposite to the first beam plate with respect to the first cartridge when the supporting member supports the first cartridge, the second beam plate extending in the first direction between the first side plate and the second side plate, the second beam plate being a flat plate, wherein an upper edge of the first beam plate is separated away from an upper edge of the second beam plate by a first distance, and wherein a lower edge of the first beam plate is separated away from a lower edge of the second beam plate by a second distance, the first distance being equal to the second distance.

17. The image forming apparatus as recited in claim 1, wherein the main casing comprises a body-side electrode and the first cartridge includes a cartridge-side electrode configured to contact the body-side electrode, and wherein the cartridge-side electrode is positioned higher than an upper edge of the first side plate and an upper edge of the second side plate in the up-down direction when the first cartridge is supported in the supporting member.

18. The image forming apparatus as recited in claim 1, wherein the first cartridge includes a developing coupling and a drum coupling, and wherein the developing coupling is positioned higher than an upper edge of the first side plate and an upper edge of the second side plate in the up-down direction when the first cartridge is supported in the supporting member.

19. The image forming apparatus as recited in claim 18, wherein the first side plate includes a coupling hole, and wherein the drum coupling is positioned to be aligned with the coupling hole of the first cartridge is supported in the supporting member.

* * * * *